US005244264A

United States Patent [19]

Woodard

[11] Patent Number: 5,244,264

[45] Date of Patent: Sep. 14, 1993

[54] WRAP AROUND BASE RAIL ASSEMBLY FOR ROOFTOP AIR CONDITIONERS

[75] Inventor: Craig B. Woodard, Franklin, Tenn.

[73] Assignee: Inter-City Products Corporation (USA), LaVergne, Tenn.

[21] Appl. No.: 819,276

[22] Filed: Jan. 10, 1992

[51] Int. Cl.[5] ..... A47B 81/00

[52] U.S. Cl. ..... 312/100; 312/265.1

[58] Field of Search ..... 312/100, 102, 265.1, 312/265.4; 62/323.1, 247, 259.1; 52/125.2, 264, 265, 632

[56] References Cited

U.S. PATENT DOCUMENTS

| | | | |
|---|---|---|---|
| 2,078,581 | 4/1937 | Muller | 312/265.1 |
| 2,954,877 | 10/1960 | Sweynor | 211/175 |
| 3,702,211 | 11/1972 | Young et al. | 312/257 |
| 3,721,106 | 3/1973 | Bierwirth et al. | 62/297 |
| 3,878,655 | 4/1975 | Toth et al. | 52/27 |
| 4,016,729 | 4/1977 | Cherry | 62/259 |
| 4,056,295 | 11/1977 | Downing | 312/265.1 |
| 4,118,083 | 10/1978 | Lackey et al. | 312/100 |
| 4,574,549 | 3/1986 | Holcombe | 52/632 |
| 4,637,179 | 1/1987 | Bigelow, Jr. et al. | 52/125.2 |
| 4,662,189 | 5/1987 | Puppel | 62/449 |
| 4,747,505 | 5/1988 | Hansen | 220/84 |
| 4,920,764 | 5/1990 | Martin | 62/259 |
| 4,976,114 | 12/1990 | Manning | 62/323 |
| 4,992,005 | 2/1991 | Hilfiker | 52/125.2 |

*Primary Examiner*—Victor N. Sakran
*Attorney, Agent, or Firm*—Baker & Daniels

[57] ABSTRACT

The present invention is a base assembly for a rooftop air conditioner. The offset tongue of one base rail is slidably received by an open end of the other base rail so that the length of the base assembly may be altered by simply slidably adjusting the relative position of the base rails. The base rails may have a U-shape or an L-shape so that when connected a rectangular base assembly is formed. Alternatively, the base assembly may include side rails and end rails which form a rectangular shape. The side rails and the end rails are formed from a single sheet of steel having a uniform width. The steel sheet is cut into four sections, with the side rails having tongues formed in their ends which engage open ends of the end rails. The corners of the base rails or end rails are integrally formed by bending the rails along lines at selected positions.

22 Claims, 2 Drawing Sheets

WRAP AROUND BASE RAIL ASSEMBLY FOR ROOFTOP AIR CONDITIONERS

BACKGROUND OF THE INVENTION

1. Field of the Invention

The present invention relates to air conditioning units mounted on the roof tops of buildings. More specifically, the field of the invention is that of base assemblies for roof top air conditioners.

2. Prior Art.

Many buildings, particularly small and medium sized commercial buildings, have flat roofs on which air conditioning units are located. These buildings include curb structures which both support the large and heavy machinery of the air conditioning unit, and connect the air conditioning unit with air passages and electrical lines of the building. Rooftop air conditioners generally include an air conditioning unit disposed within a cabinet or housing, with the cabinet or housing supported on the curb of the flat roof deck. Base assemblies may provide support for the air conditioning unit, and are generally rectangular for supporting rectangular base pans disposed within the base assembly and on the roof curb. Many base assemblies are disposed around the perimeter of the roof curb which supports both the base pans and the base assembly, although some base assemblies support the base pans above the roof curb.

Base assemblies which are peripherally disposed around the curb do not need to support the weight of the air conditioning unit because it is mainly supported by the roof curb. For such peripherally disposed air conditioners, structural stress is applied to the base assembly primarily during storage, shipment, and installation. During storage and shipment of the air conditioner, the load on the base assembly is the entire weight of the air conditioning unit, a much greater load than the load on the base assembly after the unit is installed. In regards to installation, the peripherally disposed base assembly still must provide a structure which facilitates the attachment of the rooftop air conditioner unit to the delivery vehicle, which is typically a crane or helicopter. Therefore, the structural strength of such a base assembly is most important during the storage, shipment, and installation of peripherally disposed rooftop air conditioners.

The cost of delivering the air conditioner is another factor in the total cost of a rooftop unit, and the delivery or shipping expense increases with the shipping weight of the unit. Rooftop air conditioners are generally transported with additional materials that protect the unit during transportation and facilitate installation. These additional protective materials add to the shipping weight of the unit, and require additional time and effort to remove during installation. Therefore, one desirable feature of a rooftop air conditioner is a relatively low shipping weight because the delivery cost of the unit increases in proportion to its shipping weight.

Prior art base assemblies are generally formed of four side rails joined together at their corners by welding or similar process to form a seam on the vertical web between the adjoining side rails. This vertical seam is not as structurally strong as the vertical web and thus may deform after prolonged stress. Further, to form such a corner by welding or the like, a relatively heavy gauge metal must be used. However, the manufacturing cost includes the cost of the welding process and the required additional materials, and further contributes to the weight of the air conditioner unit and therefore increases the delivery costs.

Because of the rectangular shape, prior art base assemblies are formed from at least two metal portions having different lengths. This requires at least two different lengths of the material which forms the side portions. Further, the dimensions of the base assembly cannot be changed except by cutting off part of the length of two opposite side portions. Having unequal lengths of side portions tends to increase the amount o scrap metal formed during manufacture, and thus the cost of materials is increased. Also, the additional step of adjusting the length of the side portions by physically alteration further increases manufacturing costs.

Another potential problem with prior art structures involves the manufacturing tolerances of the base pans. Typically, two or three base pans are located end to end and define the dimensions of the base assembly. Base pans are generally manufactured within preset tolerances, for example wherein the length and width of the base pan is within ±1 mm of the predetermined dimensions. In rooftop air conditioners, multiple base pans are combined together to form a larger rectangular outline, typically having three base pans. This results in the variation in length of the base assembly, for example, to be multiplied by three to ±3 mm wherein the variation of the width is within ±1 mm. In attaching the base pans to the base rails to form the base assembly, tolerances may be accommodated if they are within accepted ranges. However, if the cumulative variation is too large, the overall strength of the base assembly may be adversely effected.

In the aforementioned example, the variation of ±1 mm is acceptable, but the variation of ±3 mm is not acceptable. This is due to the ability of a preformed component, the base pan, to be able to accommodate the 1 mm difference and interfit with the other component, the base assembly, without losing significant structural strength. On the other hand, the same component may not be able to accommodate a 3 mm difference without adversely effecting its structural strength. The steel sheets which comprise the base side portion and base pan components may be bent and reformed, but each deformation of the sheet metal weakens its structural integrity. Thus by bending the sheet metal slightly, the structure is slightly weakened, and bending the sheet metal significantly may cause significant and unacceptable weakening of the sheet metal.

To avoid the problems inherent with too large of a variation, two approaches may be taken. For one, the base side portions may be formed to accommodate the largest variation and then further modified during manufacturing if the actual size needed is smaller. However, a problem with this approach of accommodation is that it involves additional manufacturing steps of measuring the actual length needed and cutting the base side portions to the length needed, both of which add to the manufacturing cost. Alternatively, the base pans may be manufactured more precisely to decrease the variation of the base pans. A problem with this approach is that manufacturing the base pans more precisely increases the expense. Thus, either approach increases the cost of manufacturing the air conditioning unit.

Prior art rooftop air conditioner units typically are moved from their place of manufacture in a shipping package which helps support the unit during transportation and installation. However, once the air conditioner is installed, the shipping package is no longer needed and often must be removed from the rooftop. Although the shipping package is necessary for lifting, maneuvering, and installing the air conditioner, removing the air conditioner from the shipping package an removing the shipping package from the rooftop adds to the cost of delivering the air conditioner unit.

What is needed is a base assembly which has structural strength to support the air conditioner during storage, shipment, and installation.

Also needed is a base assembly which minimizes its weight.

Another needs exists for a base assembly having stronger corners.

A further need is a base assembly having base rails formed of sheet metal pieces having uniform length.

A still further need is a base assembly which is easily adaptable to manufacturing variations of the base pans.

SUMMARY OF THE INVENTION

The present invention is a base assembly for a rooftop air conditioner which supports and facilitates the storage, transportation, and installation of the unit. The base assembly has structurally improved corners, and is reinforced at the lift points. A single sheet of metal can be suitably divided and bent to form the base rails, thus lowering manufacturing costs. Also, the length of the base assembly may be easily altered to accommodate manufacturing variations in the base pans because of the slidable interconnection of the base rails.

The base assembly is rectangular and is formed by the interconnection of base rails. The base rails are formed from a metal sheet and include a vertical web which connects an upper portion with a vertical flange and a lower portion having a horizontal flange. The horizontal flange supports the base pans of the air conditioner, while the vertical flange supports the base pan and abuts the sides of the air conditioner housing. The base assembly may include two U-shaped or two L-shaped base rails, or four rails including two end rails and two side rails. The two end rails are U-shaped and the two side rails are straight, with the side rails slidably connecting ends of the end rails to form rectangular frame for supporting a plurality of base pans.

Each base rail or U-shaped end rail of the base assembly includes two integral corners which are formed by bending pieces of sheet metal. The piece of sheet metal forming the integral corner has upper and lower triangular notches located at the line of the corner bend so that the upper and lower flanges abut after forming the corner bend. The corners have an integral connection at the vertical web, a distinct improvement over corners formed by physical bonding of separate base rails. The resulting corner is further reinforced by the attachment of the base pans to the horizontal and vertical flanges of the base rails. Therefore, the corners of the base assembly have an improved structure at the vertical web by virtue of the integral sheet metal, and at the upper and lower portions by virtue of the base pan connections.

The four base rails may be formed from a single metal sheet having a uniform length by simply cutting the sheet into four pieces and bending the pieces. The side rails are bent to form the horizontal and vertical flanges, and the end rails have the notches cut out before bending and forming the corners. This arrangement lowers the material costs by minimizing the scrap produced, and lowers manufacturing costs by virtue of the relatively simple processing steps.

The base assembly may be easily manufactured from relatively inexpensive materials, and the resulting structure provides more than sufficient strength to support the air conditioner during storage, transportation, and installation. Also, the side rails and end rails have overlapping portions which reinforce the base assembly where stress is most applied during installation. Lifting holes are provided at the overlapping portions so that a clevis or similar device may be used to facilitate connection of the delivery vehicle and the rooftop air conditioner. Further, the connection of the base pans to the horizontal and vertical flanges greatly increases the structural strength of the base assembly.

For the purposes of lowering the cost of shipping the unit, the weight of the base assembly should be minimized. The overlapping base rails and the use of the base pans as a supporting structure to the base rails allows a relatively thin sheet metal to be utilized with the present invention to provide a structurally secure base assembly at a reduced material cost. Further, reducing the structural complexity and the amount of materials required to manufacture the base assembly helps to reduce costs. This is achieved by forming the corners by bending, and attaching the base pans and base rails by crimping. Alternatively, other suitable means of attaching the base pans and base rails may be used, for example by spot welding, screws, etc.

The present invention, in one form, is an air conditioner adapted to be mounted on a curb of a building roof. The air conditioner comprises a housing, an air conditioning unit disposed within the housing, and a base assembly supporting the housing on the roof curb. The base assembly is connected to the housing adjacent the roof curb and includes a pair of base rails. The base rails each include first and second ends, with the first ends shaped for sliding interfitting with said second ends whereby the length of the base assembly may be altered by slidably adjusting the relative positions of the base rails.

The present invention, in another form, is an air conditioner for mounting on a curb of a building roof. The air conditioner includes a housing, an air conditioning unit disposed within the housing, and a base assembly which is connected to the housing adjacent the roof curb. The base assembly includes a pair of side rails having tongues and a pair of end rails having ends, with the side rails and the end rails being formed from a single sheet having a uniform length. The end rails are generally U-shaped and have two integral corners, with the tongues and the ends being connected and forming a generally rectangular shape.

One object of the present invention is to provide a base assembly which has structural strength to support the air conditioner during storage, shipment, and installation.

Also an object is providing a base assembly which minimizes its weight.

Another object is to provide a base assembly having stronger corners.

A further object involves providing a base assembly having base rails formed of sheet metal pieces having uniform length.

A still further object is the provision of a base assembly which is easily adaptable to manufacturing variations of the base pans.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplifications are not to be construed as limiting the scope of the invention in any manner.

DESCRIPTION OF THE PREFERRED EMBODIMENT

Figure 1:
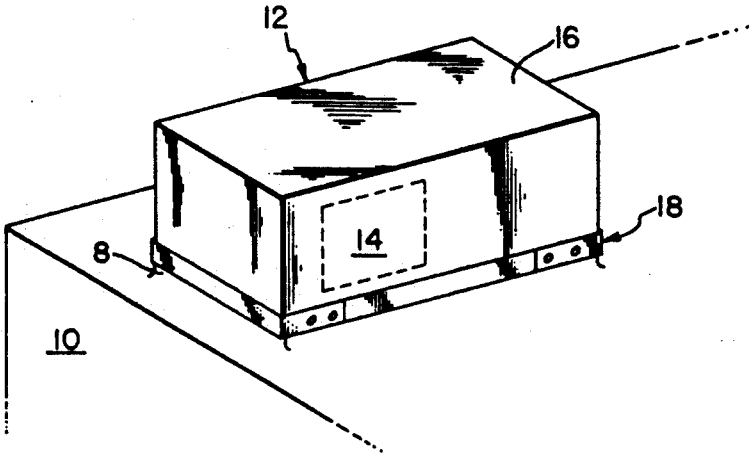
FIG. 1 is perspective view of a rooftop air conditioner of the present invention mounted on a building.

The present invention relates to rooftop air conditioners such as shown in FIG. 1. Mounted on curb 8 of building 10, air conditioner 12 includes air conditioning unit 14 disposed within rooftop housing 16. Air conditioning unit 14 is of well known design, and in the preferred embodiment may comprise a 7.5 to 20 ton air conditioning unit. The term "air conditioning unit" as used in this application includes heating and/or cooling apparatus which utilize air cooling equipment, heat pumps, natural gas heating, electric strip heating, and the like. Similarly, housing 16 is of well known design, and also may include removable access panels such as disclosed in copending U.S. Pat. application entitled "REMOVABLE ACCESS PANELS FOR ROOFTOP UNIT", Ser. No. 07/677,234, filed on Mar. 29, 1991, assigned to the assignee of the present invention, the disclosure of which is explicitly incorporated by reference.

In accordance with the present invention, rooftop air conditioner 12 includes base assembly 18. In the embodiment shown in FIGS. 2–6, base assembly 18 includes two elongated side rails 20 extending between two U-shaped end rails 22 forming a rectangular shape. Each end rail 22 includes a pair of open ends 24 which slidably receive offset tongues 26 from the ends of side rails 20. The length of base assembly 18 may be altered by adjusting the precise position of tongues 26, and thereby accommodate manufacturing variations of three base pans 28 disposed end to end within base assembly 18, see FIG. 6.

Tongues 26 fit inside open ends 24 so that portions of side rails 20 and end rails 22 overlap. Tongues 26 extend vertically and are offset inside open ends 24 to provide vertical support to the coextensive side rails 20. Further, tongues 26 are slightly smaller in height than side rails 20 and may slide within open ends 24 for adjustment of the overall length of base assembly 18.

Pairs of lifting holes 30 are located at each of four lifting positions where rails 20 and 22 overlap. Each Lifting position includes two spaced apart holes 30 which are adapted to allow a clevis (not shown) or other article to extend through and provide a mounting or tieing position for the attachment of ropes, chains, and the like. Using lifting holes 30 in conjunction with a clevis greatly facilitates the transportation and installation of rooftop air conditioner 12. Two holes 30 are formed on each end 24, and each tongue 26 may include matching holes or slots (not shown), although preferably the apertures in tongues 26 are larger than holes 30 in ends 24 to allow for slidably adjusting the length of base assembly 18.

Figure 4:
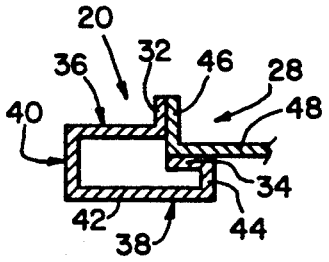
FIG. 4 is a cross sectional view, taken along view lines 4—4 of FIG. 3.
Figure 2:
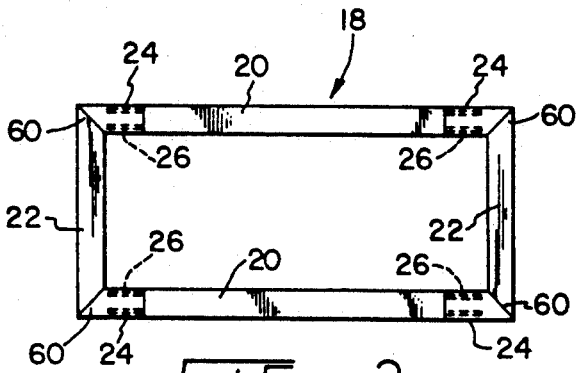
FIG. 2 is a top plan view of the base assembly.

Rails 20 and 22 include vertical flanges 32 and horizontal flanges 34 for supporting base pans 28, see the cross-sectional view of side rail 20 in FIG. 4 (with the cross section of end rails 22 being substantially the same in the preferred embodiment) Side rail 20 includes upper portion 36 and lower portion 38 which are connected by vertical web 40. Upper portion 36 includes upwardly extending vertical flange 32, and lower portion 38 includes base 42 and projection 44 which at its top includes horizontal flange 34. Horizontal flange 34 is located below the bottom of vertical flange 32 so that upstanding edge 46 of base pan 28 is supported by vertical flange 32 and planar portion 48 of base pan 28 is supported by horizontal flange 34. Preferably, edge 46 and flange 32 are coupled by a crimping method. Also preferably, planar portion 48 and flange 34 are connected by screws or other suitable fasteners. The connection of base pan 28 to flanges 32 and 34 provides a strong structure for supporting the weight of air conditioning unit 14.

Figure 5:
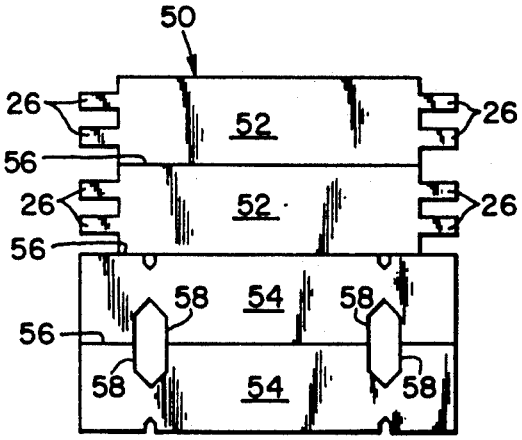
FIG. 5 is a top plan view of a piece of sheet metal used to manufacture the base assembly of the present invention.
Figure 3:
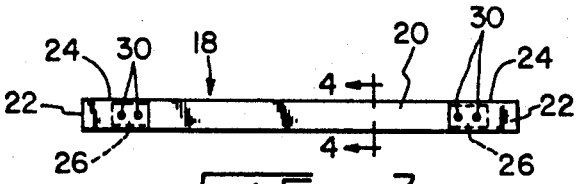
FIG. 3 is a side view of the base assembly.
Figure 6:
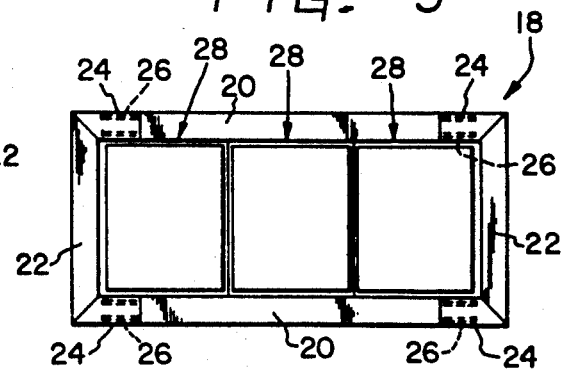
FIG. 6 is a top plan view of the base assembly with three base pans.

Base assembly 18 may be formed from a single piece of sheet metal such as sheet 50 as shown in FIG. 5. Sheet 50 includes two side portions 52 and two end portions 54, all of the same length, which are formed by separating sheet 50 along lines 56. Side and end portions 52 and 54 are then bent five times to the shape shown in FIG. 4. A specific example of the shape and bend lines of side and end portions 52 and 54 are described in more particularity below in the discussion of FIGS. 9 and 10. The ends of side portions 52 are cut to form tongues 26 and then compressed to offset tongues 26. Notches 58 are formed in end portions 54 so that corners 60 may be formed as described below. Manufacturing base assembly 18 from a single sheet 50 is economical because the amount of scrap metal produced is reduced and the formation of the base rails is simplified.

Figure 9:
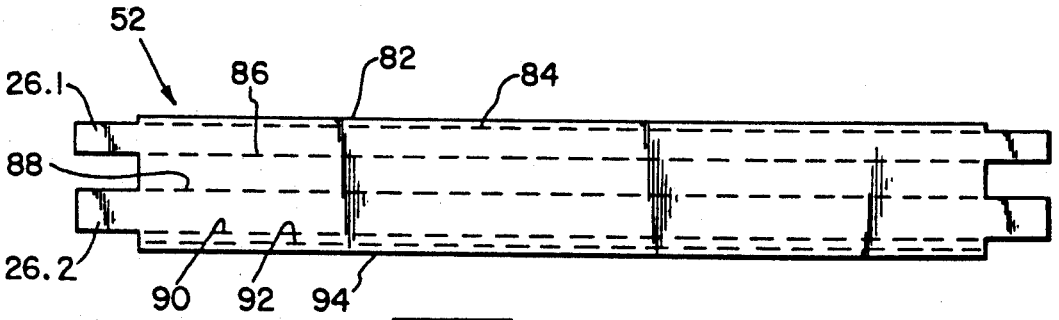
FIG. 9 is a top plan view of a side rail before bending.

Referring to FIG. 9, side portion 52 includes top edge 82, tongues 26.1 and 26.2, bottom edge 92, and are bent at right angles along bend lines 84, 86, 88, and 90 to form a cross-sectional shape similar to that shown in FIG. 4. In this exemplary embodiment, the distance between top edge 82 and bend line 84 is about 12.7 mm. The distance between bend lines 4 and 86, and thus the width of tongue 26.1, is about 61.6 mm. The distance between bend lines 86 and 88 is about 73.4 mm. The distance between bend lines 88 and 90, and thus the width of tongue 26.2, is about 81.7 mm. The distance between bend lines 90 and 92 is about 22.3 mm. Finally, the distance between bottom edge 92 and bend line 90 is about 19.1 mm.

Figure 10:
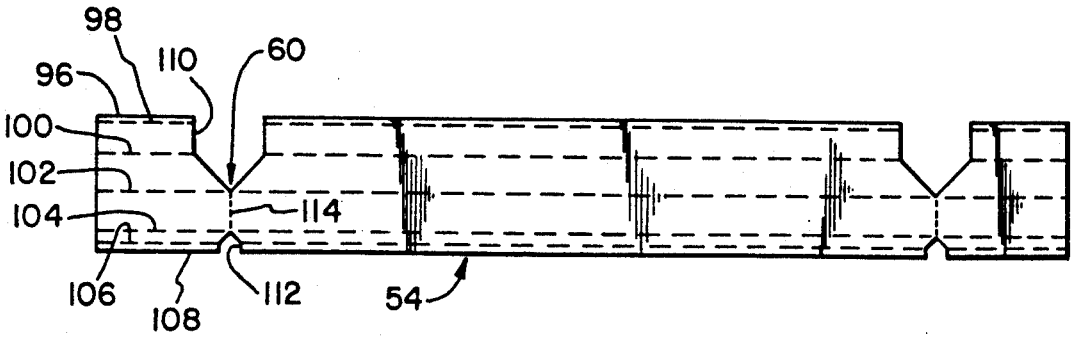
FIG. 10 is a top plan view of an end rail before bending.

Referring to FIG. 10, end portion 54 includes top edge 96, bottom edge 108, and are bent at right angles along bend lines 98, 100, 102, 104, and 106 to form a cross-sectional shape generally similar to that shown in FIG. 4, but slightly larger. In this exemplary embodiment, the distance between top edge 96 and bend line 98 is about 14.2 mm. The distance between bend lines 98 and 100 is about 59.1 mm; between bend lines 100 and 102 about 73.7 mm; between bend lines 102 and 104 about 84.3; and between bend lines 104 and 106 about 21.1 mm. Finally, the distance between bottom edge 108 and bend line 106 is about 19.4 mm.

Corners 60 of base assembly 18 are integrally formed by bending end portions 54 after bending along lines 98, 100, 102, 104, and 106. Notch cut-outs 110 and 112 are shaped in the form of a pentagon having a square base. Upper cut-out 110 is about 148.1 mm wide from upper edge 96 to bend line 100, then each side angles together to connect at bend line 102. Lower cut-out 112 is about 44.7 mm wide from lower edge 108 to bend line 106, then each side angles together to connect at bend line 104. Corners 60 are formed at about a 90° angle at bend line 114 so that the edges of notches 110 and 112 abut. However, the edges of notches 110 and 112 do not require any welding or other bonding because vertical web 40 and the connection of vertical flange 32 with upstanding edge 46 securely hold together corner 60.

In two exemplary embodiments, side base rails and end base rails are formed from a single sheet of 16 gauge steel having the dimensions of 79.3 inches by 42.7 inches, or alternatively the dimensions of 89.2 inches by 42.7 inches. These arrangements may support air conditioning units having a rating in the range of 7.5 to 20 tons.

Figure 7:
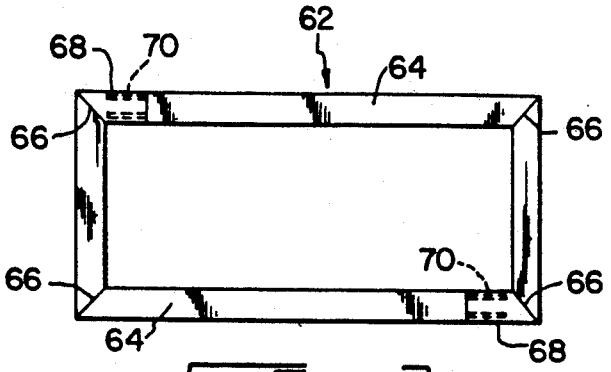
FIG. 7 is a top plan view of a second embodiment of the base assembly.
Figure 8:
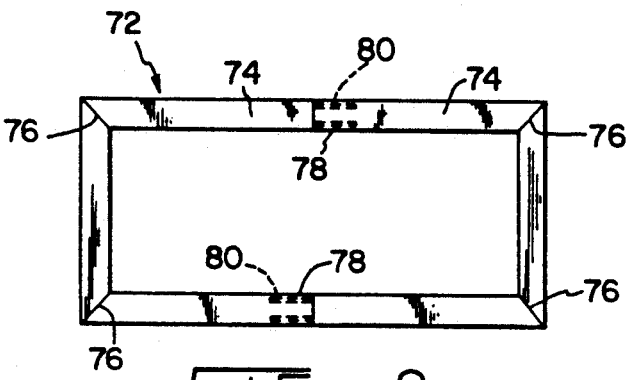
FIG. 8 is a top plan view of a third embodiment of the base assembly.

Alternative embodiments of the present invention which have two base rails forming the base assembly are shown in FIGS. 7 and 8. Base assembly 62 of FIG. 7 comprises two L-shaped base rails 64 connected together to form a rectangular assembly. Base rails 64 each have two corners 66 formed similarly to corners 60 of base assembly 18, and have a cross-sectional shape similar to that shown in FIG. 4. Each base rail 64 has receiving end 68 and tongue end 70, with base rails 64 arranged so that the respective receiving end 68 is connected to the respective tongue ed 70. Base assembly 72 of FIG. 8 comprises two U-shaped base rails 74 connected together to form a rectangular assembly. Base rails 74 each have two corners 76 formed similarly to corners 60 of base assembly 18, and have a cross-sectional shape similar to that shown in FIG. 4. Each base rail 74 has receiving end 78 and tongue end 80, with base rails 74 arranged so that the respective receiving end 78 is connected to the respective tongue end 80. Base assemblies 62 and 72 may be formed from a single piece of sheet metal similarly to base assembly 18 as described above, with the sheet metal being longer and the base rails having notches so that corners 66 and 76 may be formed.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An air conditioner adapted to be mounted on a curb of a building roof, said air conditioner comprising:

a housing;

an air conditioning unit disposed within said housing; and a base assembly connected to said housing and adapted to support said air conditioner on the roof curb, said base assembly including a pair of base rails, said base rails each including two corners, each of said corners formed by each said base rail being bent along a line of said corner, said base assembly including means for slidingly interfitting said base rails whereby one dimension of said base assembly is capable of being altered by slidably adjusting the relative position of said base rails.

2. The air conditioner of claim 1 wherein said base assembly includes a pair of lifting holes having a shape capable of receiving lifting device and said air conditioner is thereby capable of being lifted by means of the lifting device.

3. The air conditioner of claim 2 wherein said base rails include overlapping portion each having a pair of openings, and said base rail openings define said lifting holes whereby the lifting device is supported by said overlapping portions of said base rails.

4. The air conditioner of claim 1 wherein said base rails are generally U-shaped.

5. The air conditioner of claim 1 wherein said base rails are generally L-shaped and arranged to form a rectangle.

6. The air conditioner of claim 1 wherein said base rails are each formed from a single sheet and includes two integral corners.

7. The air conditioner of claim 1 wherein said base rails are U-shaped and are formed from a steel sheet, each of said corners formed by an integral sheet which is bent along a line of said corner.

8. The air conditioner of claim 1 wherein said base rail are formed from a steel sheet.

9. The air conditioner of claim 1 wherein each of said base rails includes a first end and a second end, said first ends including tongues which are offset and said second ends being open, said offset tongues being structured and arranged to fit inside said open second ends.

10. The air conditioner of claim 1 wherein said base assembly includes a plurality of base pans, with said base pans being connected to said base rails.

11. The air conditioner of claim 10 wherein said base assembly includes three of said base pans arranged end to end.

12. An air conditioner adapted to be mounted on a curb of a building roof, said air conditioner comprising:

a housing;

a base assembly connected to said housing and adapted to support said air conditioning unit on the roof curb, said base assembly including a pair of side rails including tongues and a pair of end rails having ends, said side rails and said end rails being formed from a single sheet having a uniform length, said end rails being generally U-shaped and having two integral corners, each of said corners formed said single sheet being bent along a line of said corner, whereby said tongues and said ends are connected and said side and end rails form a generally rectangular shape.

13. The air conditioner of claim 12 wherein said base assembly includes a pair of lifting holes whereby a clevis may enter and said air conditioner may be lifted by means of the clevis.

14. The air conditioner of claim 13 wherein said side rails and said end rails include overlapping portions each having a pair of openings, and said side rail openings and said end rail openings define said lifting holes whereby the clevis is supported by said overlapping portions of said side rails and said end rails.

15. The air condition of claim 12 wherein said tongues are offset and said ends are open, said offset tongues being structured and arranged to fit inside and slidably engage said open ends.

16. The air conditioned of claim 12 wherein said base assembly includes a plurality of base pans, with said base pans being connected to said side rails and said end rails.

17. The air conditioner of claim 16 wherein said base assembly includes three of said base pans arranged end to end.

18. An air conditioner adapted to be mounted on a curb of a building roof, said air conditioner comprising:

a housing;

an air conditioning unit disposed within said housing; and a base assembly connected to said housing and adapted to support said air conditioning unit on the roof curb, said base assembly including a pair of side rails and a pair of end rails, said side rails and said end rails being formed from a single sheet having a uniform length, said end rails being generally U-shaped end having two integral corners, said end rails each including tongues and said side rails each having open ends arranged so that said tongues and said open ends are slidably connected whereby the length of said base assembly are capable of being altered by slidably adjusting the relative positions of said side rails and said end rails.

19. The air conditioner of claim 18 wherein said base assembly includes a pair of lifting holes having a shape capable of receiving a lifting device and said air conditioner is thereby capable of being lifted by means of the lifting device.

20. The air conditioner of claim 19 wherein said side rails and said end rails include overlapping portions each having a pair of openings, and said side rail openings and said end rail openings define said lifting holes whereby the lifting device is supported by said overlapping portions of said side rails and said end rails.

21. The air conditioner of claim 18 wherein said base assembly includes three base pans, with said base pans being connected to said side rails and said end rails, said base pans being arranged end to end.

22. For use with an air conditioner, a base assembly adapted to support the air conditioner on a curb of a building roof, said base assembly comprising:

a first and second air conditioner on a curb of a building roof, said base assembly comprising:

a first and a second base rail, each of said first and second base rails including two ends, said first and second base rails arranged in a generally rectangular shape with said first base rail ends coupled to said second base rail ends, said base rails each including two corners, each of said corners formed by each said base rail being bent along a line of said corner; and means for slidingly interfitting said first base rail ends with said second base rail ends whereby one dimension of said base assembly is capable of being altered by slidably adjusting the relative positions of said first and second base rails.

* * * * *

UNITED STATES PATENT AND TRADEMARK OFFICE

CERTIFICATE OF CORRECTION

PATENT NO. : 5,244,264

DATED : September 14, 1993

INVENTOR(S) : Craig B. Woodard

It is certified that error appears in the above-identified patent and that said Letters Patent is hereby corrected as shown below:

Claim 2, column 8, line 19, after "receiving" insert --a--.

Claim 8, column 8, line 40, change "rail" to --rails--.

Claim 12, column 8, line 54, after "housing;" insert --an air conditioning unit disposed within said housing; and--.

Claim 18, column 9, line 32, change "end" to --and--.

Claim 22, column 10, lines 21 and 22, delete in their entirety.

Signed and Sealed this

Fifth Day of April, 1994

Bruce Lehman

*Attest:*

BRUCE LEHMAN

*Attesting Officer*

*Commissioner of Patents and Trademarks*